United States Patent [19]

Mitchell

[11] 4,165,029

[45] Aug. 21, 1979

[54] PAPER ADVANCE MECHANISM FOR AN INK JET PRINTER

[75] Inventor: Charles S. Mitchell, Palo Alto, Calif.

[73] Assignee: Silonics, Inc., Sunnyvale, Calif.

[21] Appl. No.: 837,555

[22] Filed: Sep. 28, 1977

[51] Int. Cl.[2] ..... B65H 17/22

[52] U.S. Cl. ..... 226/25; 226/114; 226/183; 226/185; 226/187; 346/136

[58] Field of Search ..... 226/113, 114, 181, 183, 226/185, 186, 187, 25; 346/136

[56] References Cited

U.S. PATENT DOCUMENTS

| | | | |
|---|---|---|---|
| 2,246,004 | 6/1941 | Rich | 346/136 X |
| 2,660,380 | 11/1953 | Blackman | 346/136 UX |
| 3,966,108 | 6/1976 | Boyd | 226/114 |
| 4,033,560 | 7/1977 | Frey | 226/114 X |
| 4,038,666 | 7/1977 | Fuller | 346/136 |

*Primary Examiner*—Richard A. Schacher

*Attorney, Agent, or Firm*—Limbach, Limbach & Sutton

[57] ABSTRACT

An advancing mechanism for a recording web, such as paper, for an ink jet printer. The apparatus, including a platen having coaxially mounted discs on a shaft with the center disc of much higher coefficient of friction than the remaining discs, a tensioning roller, a pinch roller, and a recording web holding means, is self-aligning and self-threading, having low power requirements. Means for indicating the exhaustion of the recording web is also provided.

7 Claims, 4 Drawing Figures

PAPER ADVANCE MECHANISM FOR AN INK JET PRINTER

BACKGROUND OF THE INVENTION

This invention relates generally to the art of non-impact printing, and more particularly to advancing mechanisms for a web of recording medium for ink jet printing.

An asynchronous volume displacement droplet ejection type of ink jet head is described in U.S. Pat. No. 3,946,398 - Kyser et al (1976) and co-pending patent application Ser. No. 489,985, filed July 19, 1974, both assigned to the assignee of the present application. A piezoelectric element is associated with an ink jet chamber, resulting in ejecting a droplet of ink from a nozzle of the chamber with sufficient velocity for it to travel to a recording medium. One such droplet forms a portion of a character to be printed. A plurality, such as seven or nine, print heads of this type are preferably built as a single structure that is mechanically swept across a recording medium upon which the printing is taking place line by line. At each column of the printing line the appropriate number of the independently controllable ink jet chambers are fired by pulsing their respective piezoelectric elements to eject ink drops therefrom.

Such a mode of printing requires a means for advancing the recording medium after a line of printing has been completed. Previous efforts in this area of non-impact printing are needlessly complex with high power requirements and are not entirely suitable for this method of asynchronous ink jet printing. The present invention, directed toward non-impact printing and particularly toward asynchronous ink jet printing, provides an improved recording medium advancing mechanism for ink jet printing with some unique features.

OBJECTS AND SUMMARY OF THE INVENTION

It is an object of the present invention to make an advancing mechanism for a recording medium in a non-impact printer with reduced complexity.

It is another object of the present invention to make an advancing mechanism for a recording medium in a non-impact printer with low power requirements.

It is another object of the present invention to make such an advancing mechanism which self-aligns the recording medium.

It is a further object of the present invention to make such an advancing mechanism which self-threads the recording medium.

It is still a further object of the present invention to provide a means for indicating the exhaustion of the recording web holding means.

To achieve these objectives, the present invention provides for a roll of recording web, a platen having several discs coaxially mounted on a shaft, the central disc with its circumference covered with rubber, a tensioning roller located between the roll and the platen which roller engages the web and resiliently presses it against the platen. The web from the roll moves over the tensioning roller and between the roller and the platen. The web loops under and around the platen, between the platen and a guide surface which closely follows the shape of the platen. The web continues around the platen to pass under a pinch roller which presses the web against the central disc of the platen. A print head moving parallel to the axis of the platen ejects ink droplets upon the web between the end of the guide surface and the pinch roller. The web is advanced by a belt and pulley mounted on the platen at one end of the shaft.

Mounted on one end of the spindle upon which the roll of recording web rotates is a rotary switch or an optical shaft encoder by which a series of electrical impulses is generated when the web is advanced and the roll rotated. When the number of impulses between line advances drops to zero, the printing operation of the printer is shut down and an "Add Paper" signal is turned on. This avoids a possibility of the ink jet print head ejecting ink droplets into the ink jet printer mechanism, rather than upon the recording web.

Previous methods of monitoring the supply of recording web generally require that either the end of the recording web on the roll be attached to a spool or be free of the spool. For instance, one previous indicator requiring the end of the web to be free is an optical switch which is placed along the path of the web. The web interrupts the switch. When the recording web is exhausted, the end of the web passes the switch and the switch gives an "empty" signal. Similarly, an arm pressing against the web somewhere along the path of the web is another indicator used previously. It generally must be set to handle a roll with the end of the web either attached or free. But such a device cannot handle both cases. Exhaustion of the web allows the arm to make a full deflection which triggers an "empty" signal. A further indicator is an arm pressing against the roll itself working with either the web end attached or free. However, it is not very accurate in determining the end of the roll. In contrast to these previous examples, the present embodiment is effective whether the web is attached or free and is quite accurate in indicating the end of the roll.

BRIEF DESCRIPTION OF THE DRAWINGS

The present invention can readily be understood by reference to the following drawings.

DETAILED DESCRIPTION OF THE PREFERRED EMBODIMENTS

Figure 1:
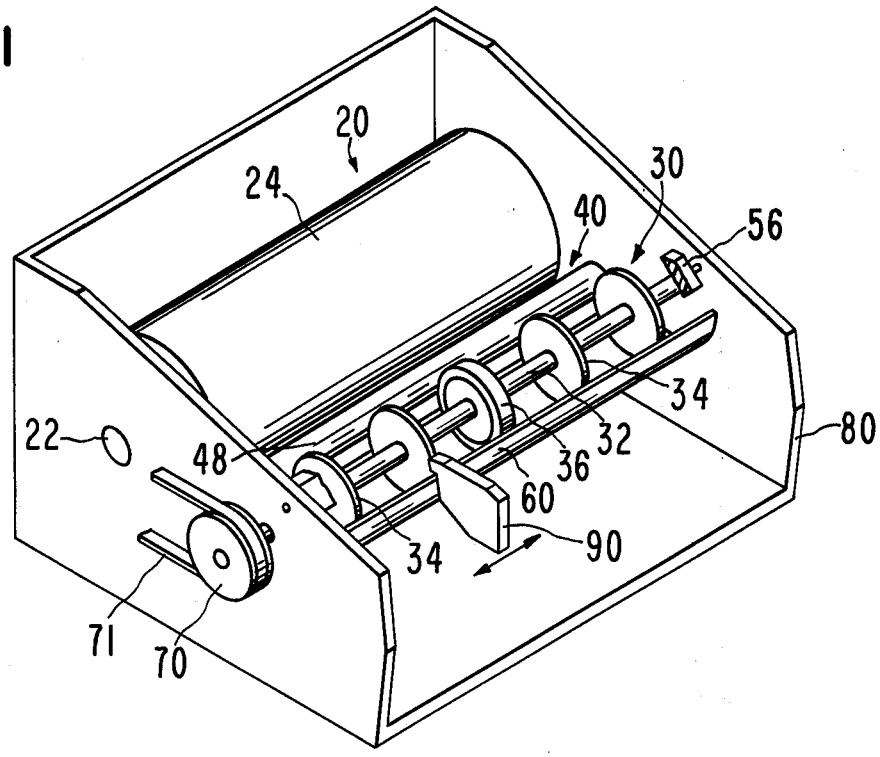
FIG. 1 shows an isometric view of the recording medium advance mechanism, without the recording web threaded through the mechanism.
Figure 2:
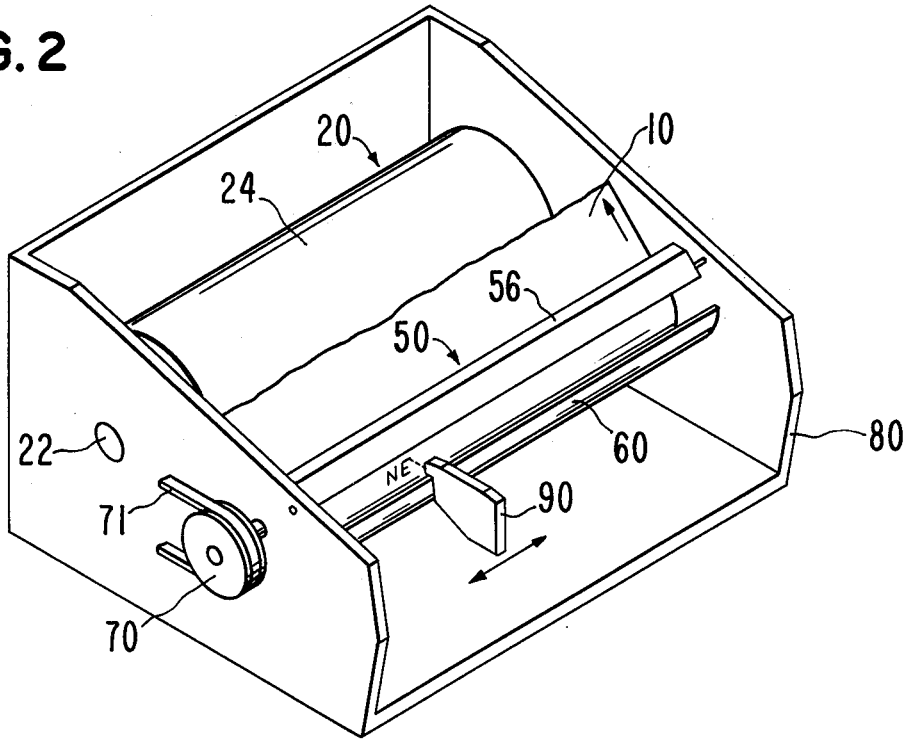
FIG. 2 shows the same isometric view as FIG. 1 with the recording web threaded and the ink jet print head ejecting ink droplets.
Figure 3:
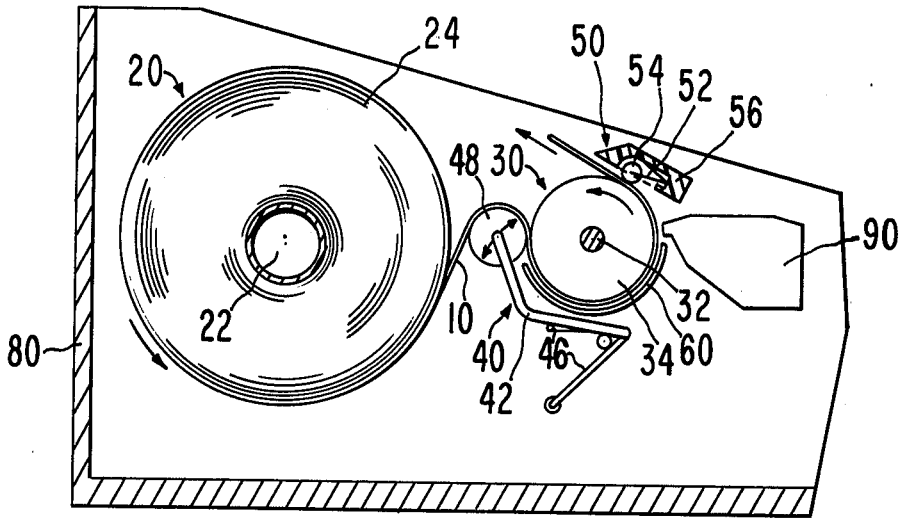
FIG. 3 is a side view of the mechanism. The pulley and belt to drive the cylinder means is removed for a better illustration. The action of the pinch roller against the central disc is also shown.

Referring to FIG. 3, a recording web 10 leaves a recording web holding means 20 to pass over a tensioning means 40, and then between the tensioning means and a platen 30. The web continues under, around and upward on the platen with a guiding means in a form of a guide surface 60, located mostly beneath the platen 30. After clearing the edge of the guide surface 60, the web 10 continues around the cylinder means to pass under a pinch means 50, which presses the web against the center portion of the platen, central disc 36. A print head 90 ejects and deposits droplets of ink in desired patterns on the web 10 between the guide surface 60 and the pinch means 50. FIGS. 1 and 2 illustrate the motion of the print head 90 with respect to the web 10. The distance between the print head 90 and the web 10 is exaggerated to show ink droplet ejection in FIG. 2. The recording web 10 is advanced by rotating the platen 30 by means of a pulley 70, coaxially mounted on the platen 30 and drive belt 71 connected to a stepper motor (not shown).

Figure 4:
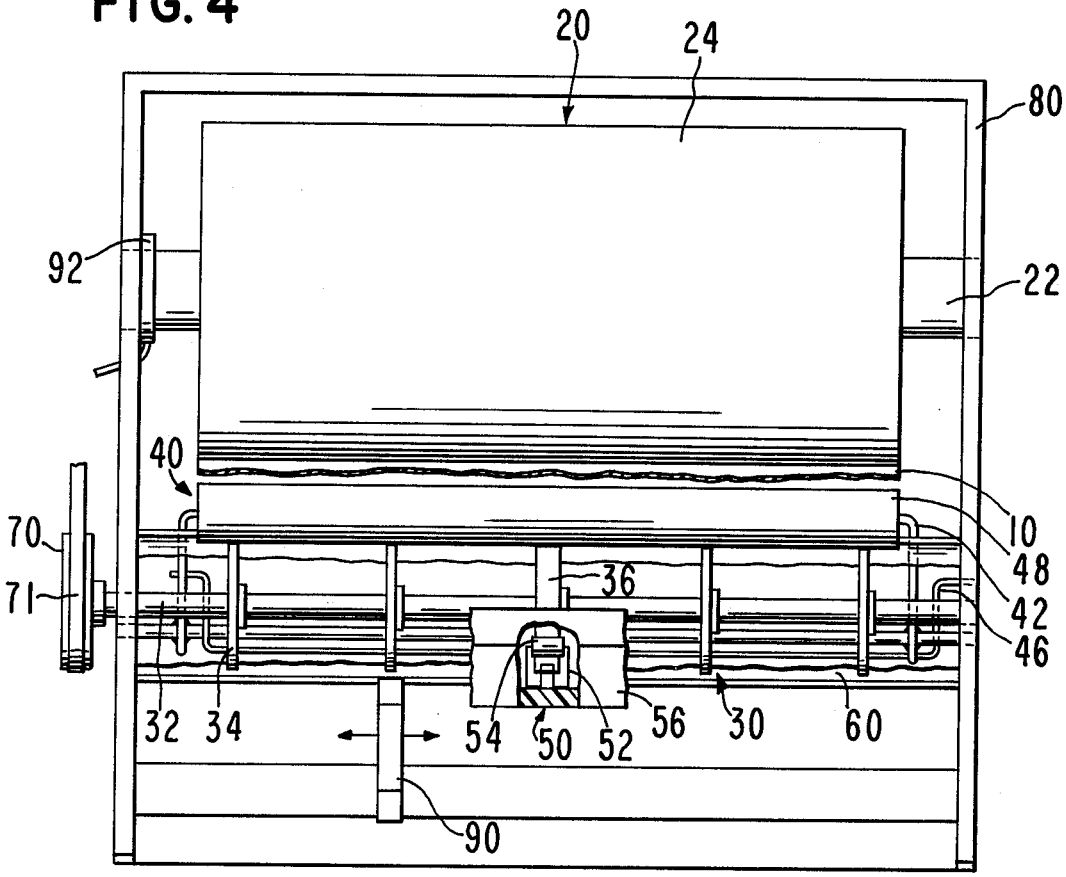
FIG. 4 is a top view. The cut-out at the center of the tear-off bar illustrates the pinch roller against the central disc.

Referring to FIGS. 3 and 4 in more detail, the recording web holding means 20 is in the form of a roll 24 of a length of recording web, rotatably mounted on a frame 80 by a spindle 22 so that the recording web can be pulled therefrom. This manner of holding means imposes a constraint upon the recording web 10 to leave the holding means in a definite and preferred direction from a fixed lateral position with respect to the center of the axis of the platen. For the roll 24, this preferred direction is perpendicular to the spindle 22, the axis of the roll 24, and the lateral position of the roll is aligned with the platen. This is an important consideration for the proper working of the present invention and is discussed further.

Alternately it is conceivable that the recording web holding means 20 take a form other than a roll. For instance, the recording web may be held in the form of a fanfold with means, such as a roller with two sets of sprockets engaging perforations on each edge of the web, to allow the web to be pulled therefrom. The preferred direction of the recording web from the holding means 20 is perpendicular to the sprocketed roller. The holding means 20 is aligned with the platen 30.

Again referring to FIGS. 3 and 4, the recording web 10 leaves the roll 24 and travels toward the platen 30 which has its axis perpendicular to the preferred direction of the recording web. Before encountering the platen, the web 10 passes over tensioning means 40, in the form of a tensioning roller 48 rotatably mounted on the upper end of a tensioning arm 42. The other end of the tensioning arm 42 passes through the frame 80 to form a pivot point for the arm. A tensioning spring 46 biases the tensioning arm 42 and the tensioning roller 48 against the platen 30. The web 10, after passing over the tensioning roller 48, passes down between the roller and the platen 30. The tensioning roller 48 extends the length of the platen 30 to ensure that the recording web 10 is fully and properly shaped as the web contacts the platen.

The platen 30, rotatably mounted on the frame 80, has a shaft 32 upon which is coaxially mounted a plurality of equal radii discs 34 and a central disc 36 which has a circumferential coefficient of friction with respect to the recording web 10 at least several times higher than the remaining discs. It has been found that the central disc 36 need not be exactly the same radius as the other discs. It is preferable, however, that the diameter of the disc 36 be slightly larger (2 mils or so) than the discs 34 in order for the self-aligning mechanism to operate optimally. Also mounted at one end of the shaft 32 is a pulley 70 which is driven by a belt 71 connected to a stepper motor or any other form of driving means (not shown). In this manner, the platen 30 is rotatably driven. When one line of printing is completed, the platen 30 is incrementally advanced to the next line and so forth. After passing between the tensioning roller 48 and the platen 30 the recording web 10 passes under, around and upward in contact with the discs 34 and 36. In close proximity is a guiding surface 60 which is located mostly below the platen 30. The guiding surface 60 follows the circumferential shape of the discs 34 and 36. Thus when the web is being threaded through the present invention, a leading edge of the recording web 10 continues upward past the print head 90 to pass under the pinching means 50.

The pinching means 50 has a roller 54 rotatably mounted at the end of a pinch arm 52, with the pinch roller 54 and the pinch arm 52 fitting into a recess opposite the center disc 36 in a tear-off bar 56. The end of the arm 52 is attached to the tear-off bar which is fixed to the frame 80. The net result is that the pinch roller 54 is resiliently pressing the recording web 10 against the disc 36 to increase the frictional engagement of the web with the disc. The recording web having passed the pinch roller 54 may be torn off from the succeeding recording web by means of a sharp upper edge of the tear-off bar 56. The tear-off bar 56, not in contact with, but extending in close proximity to the platen 30, helps the web 10 remain properly shaped on the platen 30. It also guides the web 10 after it leaves the guide surface 60 under the pinch roller 54.

The recording web 10 is advanced by the rotation of the platen 30 and only the web's contact with the central disc 36 is significant due to the disc's high coefficient of friction with respect to the web compared to the remaining discs 34. Though the tensioning roller 48 can move away from the platen 30, the area of contact of the web 10 against the central disc 36 can be said to extend generally from the point at which the web is pressed against the central disc by the tensioning roller 48 around the central disc to the pinch roller 54. The maximum amount of tension T, which can be placed on the recording web at the point where it is pressed against the central disc by the tensioning roller 48 to overcome drag and inertial forces on the web without slipping is given by the relationship:

$$T = \mu f e^{\mu\beta}$$

where,

- f is the force with which the pinch roller 54 pinches the recording web against the central disc 36;
- $\mu$ is a coefficient of friction between the center disc and the recording web; and
- $\beta$ is the angle of wrap by the recording web around the platen, which is subtended by the point where the recording web is pressed against the central disc by the tensioning roller 48 and the point where the pinch roller 54 pinches the recording web 10 against the central disc 36.

For the embodiment shown in FIG. 1, the wrap angle $\beta$ is chosen to be larger than 180°. It can readily be seen that by adjusting $\mu$, f, or the wrap angle $\beta$, or any combination thereof, the maximum amount of tension T can be changed or maintained, though there are limitations to the changes of the above parameters. The materials for the recording web and for the circumference of the center disc 36 determine $\mu$, while f cannot be so great as to deform the flat surface of the web 10 passing between the pinch roller 54 and the central disc 36.

The self-aligning feature of the present invention is related to the fact that the recording web 10 is advanced by the platen 30 only by the central disc 36. The central disc on its circumference has a high coefficient of friction with respect to the recording web 10. Additionally, the discs 34 have low coefficients of friction with respect to the web 10. For example, if the recording web is ordinary paper, a rubber coating around the central disc's circumference and construction of the remaining discs 34 out of plastic works quite satisfactorily.

The holding means 20 is laterally located with respect to the platen 30 such that the central disc 36 drives the recording web 10 along its center line. When the recording web 10 is wrapped around the platen 30 askew (that is, when the web 10 deviates from the preferred direction of the web holding means 20 and wraps around the platen 30 not perpendicular to its axis), the central disc 36 will form an angle with respect to the center line of the web. Once any slack is taken up, due to the constraint upon the web to leave the web holding means in the preferred direction and from a fixed lateral position and the fact that the web is driven by a single disc, the central disc 36, which is parallel to the preferred direction, the disc 36 will have a component of motion toward the center line of the web as the center disc is driven and the web advanced. Moreover, as the disc approaches the center line, the angle between the disc and the center line decreases until the disc is parallel to and on the center line of the web. Alignment is then achieved. Furthermore, it has been found that the central disc need not be positioned with respect to the holding means such that the central disc drives the web along its center line. Even if the disc is located to one side or the other to a certain extent, self-alignment can still be achieved. However, as the disc is moved further away from the center, the imbalances of the system due to the lack of the symmetry interfere with self-alignment more and more until it can no longer be achieved. With the holding means 20 aligned with the center at the axis of the platen 30, it is best to locate the disc 36 at or near the center of the platen 30. In the present embodiment, the recording web holding means is in a form of a roll 24 rotatably mounted on a spindle 22. Proper alignment occurs within a few rotations of the platen. To achieve the same results, it is readily conceivable to substitute a cylinder with a band of material near the center having a coefficient of friction much higher than the rest of the cylinder surface as a platen. However, such a cylinder would have a higher inertia to overcome as it is driven.

It should be noted that the position of the pivot point for tensioning arm 42 and the geometry of the path of the recording web from the web holding means to the tensioning roller 48, around the roller, and to the platen 30 is chosen so that the tensioning roller 48 is most responsive to changes in tension on the recording web 10 around the roller. Thus, the tensioning roller's motion as it moves away from the platen 30 has a large component of movement in the direction from which the web 10 is leaving the roll 24. The tensioning roller's motion is indicated in FIG. 3. The tensioning spring 24, a torsion spring, is determined such that, for a large inertial value of the roll 24 (that is, a full roll), the tensioning roller 48 moves away a good distance from the platen 30 due to the increased tension in the web 10 around the roller as the platen is rotatably driven and returns to its original position after the rotation is completed. Thus, upon rotation of the platen 30 by a stepper motor (not shown) connected to the belt 71, the roll 24 cannot immediately respond with its large inertia. Instead, the tensioning roller 48 moves down and away from the platen 30 to allow the platen to rotate to take up the additional web now made available by the depression of the tensioning roller 48. More web is then pulled and advanced from the roll 24 by the return of the spring loaded tensioning roller 48 back to its normal position against the platen 30. A result is that the power output requirements for the stepper motor is less than if the platen 30 pulled the web 10 directly from the roll 24.

A further result is that the motion of the tensioning roller 48 under the advancement of the recording web generally maintains a fairly constant tension on the web 10 around the platen 30 between the roller 48 and the pinch roller 54. This tension ensures a reliable surface pulled taut around the platen for the web as it passes in front of the print head 90 for printing. Both the inertia of the roll 24 and the friction against the rotation of the spindle 22 are retardant forces on the web as it is advanced. As the inertia of the roll 24 decreases, the amount of rotation of the spindle 22 for each line of advancement increases. Thus there is always some retardant force resistance to the advancement of the web from the roll 24, either due to inertia or the increase of friction, until the roll is exhausted. The motion of the tension roller 48 in response to this retardant force ensures a constant tension on the web around the cylinder means. For the present embodiment, it is optimum to keep friction low to lower power requirements on the stepper motor.

The present invention is also self-threading. To thread the machine, an operator pulls a sufficient length of recording web from the roll. The leading edge of the recording web is then placed between the tensioning roller 48 and the platen 30. The cylinder means is driven. Since the length of web pulled from the roll is free from drag, the web proceeds around the platen by the guiding surface 60 until the leading edge of the web passes under the pinch roller 54. The tear-off bar 56 helps lead the leading edge to and under the pinch roller. Since the recording web is now held in place around the cylinder means by the tensioning roller 48 and the pinch roller 54, it is now fully threaded and more web may be advanced off the roll without slippage.

The present invention also includes means for indicating the exhaustion of the roll 24. At one end of the spindle 22 is a rotary switch 92 which opens and closes an electrical circuit through which an electrical current can flow. Alternatively, a simple optical shaft encoder may also be used, instead of a rotary switch. As the recording web 10 is advanced off the roll 24, a series of electrical impulses 25 are generated. Exhaustion of the roll 24 causes the spindle 22 to slow or cease rotating whether the end of the recording web 10 is attached to or free of the spool of the roll 24. When the number of impulses between the line advances drop to zero, the printing operation is shut down and an "Add Paper" signal is made. An electronic circuit may be designed to do these functions. However, it is more convenient to allow a programmed microprocessor to perform these things. The microprocessor can also handle the printing operation of the ink jet print head on the recording web. It can control the stepper motor to advance the web in conjunction with the lateral movement of the print head across the web and the ejection of ink droplets.

The terms and expressions which have been employed here are used as terms of description and not of limitation, and there is no intention, in the use of such terms and expressions, of excluding equivalents of the features shown and described, or portions thereof, it being recognized that various modifications are possible within the scope of the invention claimed.

I claim:

1. An apparatus for positioning and advancing a recording web for non-impact printing, comprising:

means for holding a recording web in a manner that the web can be pulled therefrom in a preferred direction with some retarding force, a cylinder held to be rotatable about a center axis perpendicular to said preferred direction, said cylinder having a portion along its length generally in its middle that has a coefficient of friction that is at least several times higher than that of remaining cylinder portions, means resiliently urged against said cylinder in a position with respect to said cylinder and said web holding means for guiding said web in contact with said cylinder in a manner that said means withdraws from the cylinder in response to a sufficient tension on the web as the web is advanced, whereby tension is reduced and a constant tension is maintained on the web around the cylinder, and means urged against the cylinder for increasing the frictional engagement of the web with said high friction cylinder surface portion, said frictional increase means being placed at a position to contact the web after it has passed said guiding means, whereby sufficient force is applied to the web in response to the rotation of the cylinder to withdraw the web from its holding means.

2. An apparatus as recited in claim 1 which further comprises means positioned around said cylinder between said tension responsive means and said frictional engagement means for guiding a leading edge of the recording web therebetween.

3. An apparatus for positioning and advancing a recording web for a non-impact printer which comprises:

means for holding a recording web in a manner that the web can be pulled therefrom in a preferred direction with some retarding force, a platen having at least two discs of equal radii and another disc of slightly larger radius having a coefficient of friction at least several times higher than the remaining discs with said high friction disc substantially near the center, all of said discs mounted coaxially on a shaft, said platen held to be rotatable about the axis of the shaft such that the direction of the recording web from the recording web holding means is perpendicular to the axis of the platen, whereby the platen is rotatably driven to advance the recording web, means located between said web holding means and said platen and normally urging the recording web to the platen for reducing the tension of the recording web between the recording web holding means and the platen when the tension exceeds a predetermined amount, whereby tension is constantly maintained on the recording web around said platen as said platen is driven to advance the recording web, means for pinching the recording web against the center disc of the platen thereby enabling advancement of the recording web from the recording web holding means without slippage on the platen, and means for guiding the recording web from the tensioning means around the platen to the pinching means.

4. An apparatus as recited in claim 3 wherein the recording web holding means comprises a roll of recording web rotatably held on its axis parallel to the axis of the platen whereby the recording web advances perpendicular to the axis of the platen.

5. An apparatus as recited in claim 3 wherein the tensioning means comprises:

a tensioning roller about equal in length to the platen aligned with and parallel to the axis of said platen, a tensioning arm rotatably holding said tensioning roller, said arm pivotally held at one end, and a tensioning spring resiliently urging engaging said arm to urge said roller against said platen, the position of the pivotal end of said arm and strength of said spring determined such that said roller retreats from said platen when the tension on the web exceeds a predetermined amount as the platen is rotatably driven whereby said roller presses the web from said web holding means and pulls away to relieve tension on the web.

6. An apparatus as recited in claim 3, wherein the pinching means comprises:

a pinch roller resiliently urged against said central disc of said platen and positioned with respect to said tensioning means in a manner that said pinch roller will press said recording web against the said central disc of the said platen to increase the frictional engagement of said web to said central disc whereby the platen can be rotatably driven to advance the recording web without slippage.

7. An apparatus for advancing and positioning a recording web for non-impact printing, comprising:

a frame, a spindle rotatably mounted on said frame whereby a roll of recording web is rotatably held, a platen having a plurality of discs of equal radii and a disc of slightly larger radius having a coefficient of friction at least several times higher than the remaining discs, all of said discs mounted coaxially on a shaft rotatably mounted on said frame with said high friction disc substantially near the center of said shaft, said platen aligned with said spindle such that the direction of the advanced recording web from said roll is perpendicular to the said shaft, whereby the platen is rotatably driven to advance the web, a tensioning roller between said spindle and said platen approximately the length of the platen, said roller aligned with and resiliently urged against said platen by a tensioning arm rotatably holding said roller, said arm pivotally mounted to said frame, and a tensioning spring engaging said arm and said frame, the pivot point of said arm and strength of said spring determined such that the roller retreats from the platen when the tension on the web exceeds a predetermined amount where said platen is rotatably driven, whereby said roller presses the web from said roll against the platen and retreats to relieve tension on the web, a pinch roller resiliently urged against said high friction disc of the platen by a pinch arm rotatably holding said pinch roller, said pinch arm fixed at one end to a bar aligned in close proximity with said platen and mounted to said frame, said pinch roller located more than 180° from the point at which said tensioning roller presses the web against said platen around said platen on which the web is wrapped, whereby said pinch roller presses the web against said high friction disc so that the platen can be rotatably driven to advance the web without spillage, and a concave cylindrical surface located between said tensioning roller and said pinch roller in close proximity with the platen whereby a leading edge of the recording web advancing from said tensioning roller passes under said pinch roller.

* * * * *